US012623695B2

(12) United States Patent
Hwang et al.

(10) Patent No.: US 12,623,695 B2
(45) Date of Patent: May 12, 2026

(54) RAIL INSPECTION DEVICE

(71) Applicants: SEMES CO., LTD., Cheonan-si (KR); SAMSUNG ELECTRONICS CO., LTD., Suwon-si (KR)

(72) Inventors: In Kyeong Hwang, Seoul (KR); Hyuk Jae Sung, Cheonan-si (KR); Hyungsik Um, Suwon-si (KR); Hongjin Kim, Suwon-si (KR); Won Young Kim, Yongin-si (KR); Bo Seung Hwang, Yongin-si (KR); Sangjune Bae, Suwon-si (KR); Byeong Hyeon Lim, Suwon-si (KR)

(73) Assignees: SEMES CO., LTD., Cheonan-si (KR); SAMSUNG ELECTRONICS CO., LTD., Suwon-si (KR)

( * ) Notice: Subject to any disclaimer, the term of this patent is extended or adjusted under 35 U.S.C. 154(b) by 686 days.

(21) Appl. No.: 18/094,827

(22) Filed: Jan. 9, 2023

(65) Prior Publication Data

US 2023/0339523 A1 Oct. 26, 2023

(30) Foreign Application Priority Data

Apr. 20, 2022 (KR) ..... 10-2022-0048967

(51) Int. Cl.
*B61D 15/12* (2006.01)
*B61D 49/00* (2006.01)

(52) U.S. Cl.
CPC ..... *B61D 15/12* (2013.01); *B61D 49/00* (2013.01)

(58) Field of Classification Search
CPC ..... B61D 15/12; B61D 49/00; B61K 9/08
See application file for complete search history.

(56) References Cited

U.S. PATENT DOCUMENTS 7,389,694 B1 * 6/2008 Hay ..... G01N 29/265 73/635
10,168,304 B2 * 1/2019 Prince ..... G01N 29/265
(Continued)

FOREIGN PATENT DOCUMENTS

CN 212500409 U * 2/2021
JP 4710628 B2 6/2011
(Continued)

OTHER PUBLICATIONS

Office Action issued Mar. 19, 2025 by the Korean Intellectual Property Office in Korean Patent Application No. 10-2022-0048967.

(Continued)

*Primary Examiner* — Jason C Smith
(74) *Attorney, Agent, or Firm* — Sughrue Mion, PLLC

(57) ABSTRACT

A rail inspection device is provided. The rail inspection device includes: a drive part configured to drive on a lower rail; side wheels configured to rotate such that the drive part moves in a first direction on the lower rail, wherein the side wheels are provided on two side surfaces of the drive part opposite to each other in a second direction that intersects the first direction; upper wheels provided on an upper surface of the drive part and configured to rotate in contact with a branch guide rail provided above an upper portion of the drive part; a body connected to a lower surface of the drive part in a third direction that is perpendicular to the first direction and the second direction; and an inclination sensor provided on the upper surface of the drive part and configured to measure an inclination of the body.

19 Claims, 15 Drawing Sheets

(56) References Cited

U.S. PATENT DOCUMENTS

| | | | | |
|---|---|---|---|---|
| 10,429,180 | B2 | 10/2019 | Choi et al. | |
| 10,604,899 | B2 * | 3/2020 | Horii | B61K 9/08 |
| 10,739,311 | B2 * | 8/2020 | Kawabata | G01N 27/72 |
| 11,114,323 | B2 * | 9/2021 | Ogawa | H01L 21/67715 |
| 2007/0112481 | A1 | 5/2007 | Tsai et al. | |
| 2023/0339523 | A1 * | 10/2023 | Hwang | B61K 9/08 |

FOREIGN PATENT DOCUMENTS

| | | | | | |
|---|---|---|---|---|---|
| KR | 10-2010-0074356 | A | | 7/2010 | |
| KR | 20100074356 | A | * | 7/2010 | G06T 7/0004 |
| KR | 101590157 | B1 | * | 2/2016 | G01B 21/32 |
| KR | 10-2019-0065823 | A | | 6/2019 | |
| KR | 20190065823 | A | * | 6/2019 | B61B 13/00 |
| KR | 102069587 | B1 | | 1/2020 | |
| KR | 102242361 | B1 | | 4/2021 | |
| KR | 102264853 | B1 | | 6/2021 | |
| KR | 102314090 | B1 | | 10/2021 | |
| KR | 102332917 | B1 | | 11/2021 | |
| KR | 20250075001 | A | * | 5/2025 | G01B 21/22 |
| KR | 20250076011 | A | * | 5/2025 | G06Q 50/10 |

OTHER PUBLICATIONS

Office Action issued Jul. 1, 2024 by the Korean Intellectual Property Office in Korean Patent Application No. 10-2022-0048967.

* cited by examiner

RAIL INSPECTION DEVICE

CROSS-REFERENCE TO RELATED APPLICATION

This application claims priority to Korean Patent Application No. 10-2022-0048967 filed on Apr. 20, 2022 in the Korean Intellectual Property Office, the disclosure of which is incorporated by reference herein in its entirety.

BACKGROUND

1. Technical Field

The present disclosure relates to a rail inspection device.

2. Description of the Related Art

Overhead hoist transports are installed in semiconductor production plants, where there are numerous small objects to be transported. The overhead hoist transport system drives along a rail installed on a ceiling and includes a transport hoist configured to carry an object and a track with the rail for guiding driving of the transport hoist.

The overhead hoist transport includes a lower rail and an upper rail. The lower rail has branch and confluence rails to connect straight rails spaced apart from each other so as to allow the carriage to move between the spaced apart straight rails. The upper rail may refer to a rail installed for the carriage to change a movement direction in the branch and confluence rails.

After the installation of the rail of the overhead hoist transport, there is a need to confirm whether the rail is properly installed to fit the design specification. In general, a worker directly measures the installation state of the rail using a measuring machine, such as a step difference of the rail, the width thereof, the installation location of the guide rail, and the like. In this case, measured values may vary according to the worker, leading to decreased reliability, and the longer inspection time causes a decrease in productivity.

SUMMARY

One or more embodiments provide a rail inspection device that may have improved inspection reliability for a design specification of a rail.

According to an aspect of an example embodiment, a rail inspection device includes: a drive part configured to drive on a lower rail; side wheels configured to rotate such that the drive part moves in a first direction on the lower rail, wherein the side wheels are provided on two side surfaces of the drive part opposite to each other in a second direction that intersects the first direction; upper wheels provided on an upper surface of the drive part and configured to rotate in contact with a branch guide rail provided above an upper portion of the drive part; a body connected to a lower surface of the drive part in a third direction that is perpendicular to the first direction and the second direction; and an inclination sensor provided on the upper surface of the drive part and configured to measure an inclination of the body.

According to an aspect of an example embodiment, a rail inspection device includes: a drive part configured to drive on a lower rail; side wheels configured to rotate such that the drive part moves in a first direction on the lower rail, wherein the side wheels are provided on two side surfaces of the drive part opposite to each other in a second direction that intersects the first direction; upper wheels provided on an upper surface of the drive part and configured to rotate in contact with a branch guide rail provided on an upper portion of the drive part; a body connected to a lower surface of the drive part in a third direction that is perpendicular to the first direction and the second direction; an inclination sensor provided on the upper surface of the body, and configured to measure an inclination of the body in the second direction and generate an inclination detection signal based on the inclination being higher than or equal to a threshold value; and a step sensor provided in a front surface of the drive part and configured to measure a distance to the lower rail from the step sensor in the third direction based on the inclination detection signal.

According to an aspect of an example embodiment, a rail inspection device includes: a drive part configured to drive on a lower rail; side wheels configured to rotate such that the drive part moves in a first direction on the lower rail, wherein the side wheels are provided on two side surfaces of the drive part opposite to each other in a second direction that intersects the first direction; a body connected to a lower surface of the drive part in a third direction that is perpendicular to the first direction and the second direction; an inclination sensor provided on an upper surface of the body and configured to measure an inclination of the body; a protrusion detection sensor connected to a lower portion of the drive part and configured to detect a protruding object; a width measurement sensor provided on a rear surface of the drive part and configured to measure a distance to the lower rail from the width measurement sensor in the second direction using a first laser; a step sensor provided on a front surface of the drive part and configured to measure a distance to the lower rail from the step sensor in the third direction using a second laser; an alarm display provided on the body and configured to display a warning alarm; and a processor configured to control the inclination sensor, the protrusion detection sensor, the width measurement sensor, the step sensor and the alarm display, wherein the inclination sensor is further configured to provide an inclination detection signal to the processor in based on the inclination of the body being higher than or equal to a threshold value, wherein the protrusion detection sensor is further configured to provide a protrusion detection signal to the processor based on detecting a protrusion object, wherein the width measurement sensor is further configured to provide a width detection signal to the processor based on the distance to the lower rail in the second direction deviating from a first threshold range, wherein the step sensor is further configured to provide a step detection signal to the processor based on the distance to the lower rail in the third direction deviating from a second threshold range, and wherein the processor is further configured to control the alarm display to display the warning alarm based on the inclination detection signal, the protrusion detection signal, the width detection signal, or the step detection signal.

The technical aspects of the disclosure are not restricted to those set forth herein, and other unmentioned technical aspects will be clearly understood by one of ordinary skill in the art to which the disclosure pertains by referencing the detailed description of the disclosure given below.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION OF THE EMBODIMENTS

Figure 1:
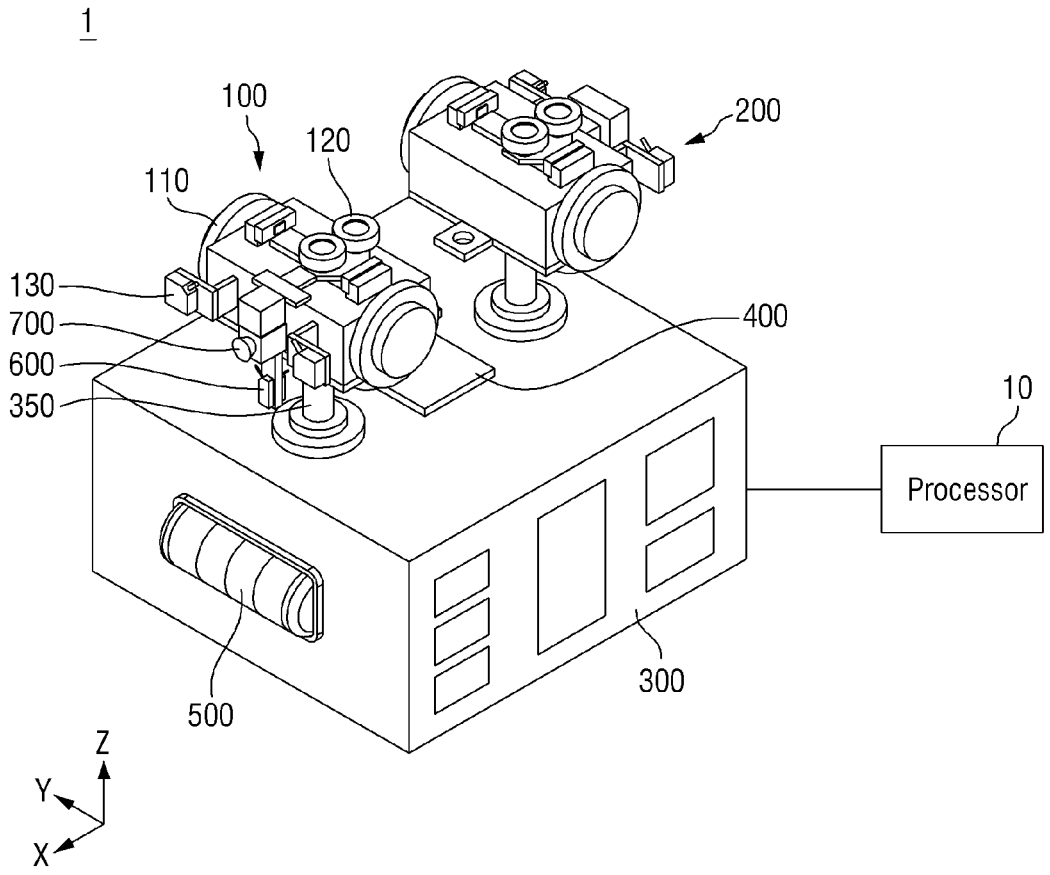
FIG. 1 is a view illustrating a rail inspection device according to an example embodiment.
Figure 2:
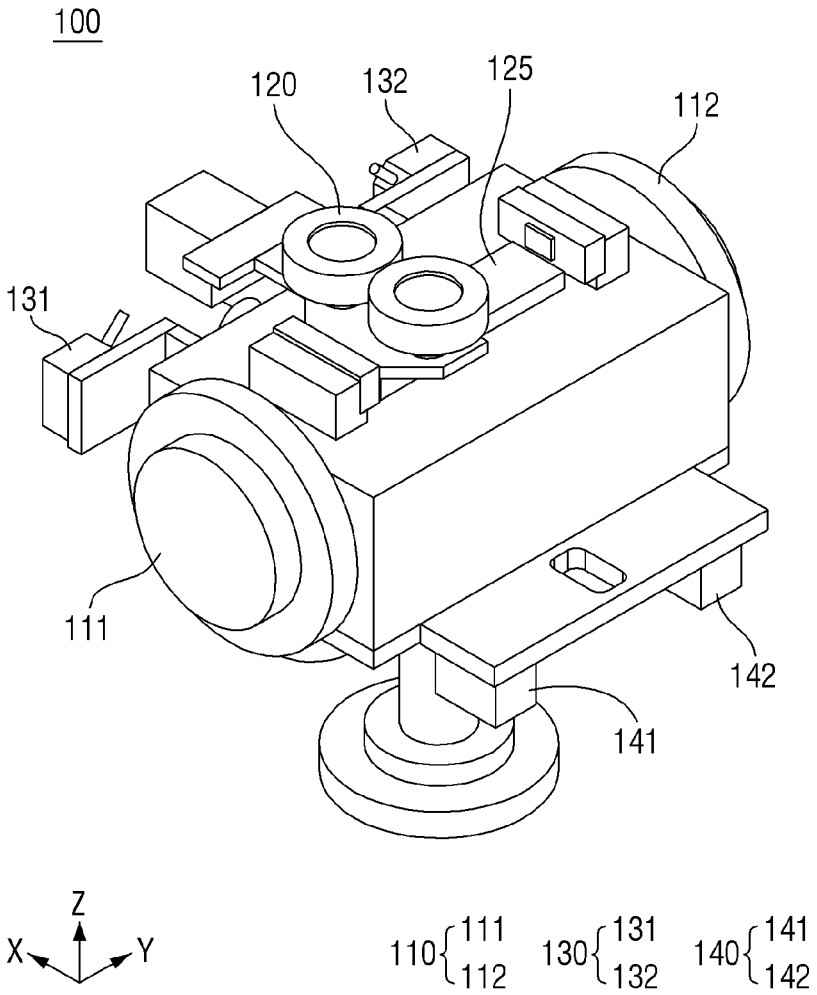
FIG. 2 is a view illustrating a drive part of the rail inspection device according to an example embodiment.
Figure 3:
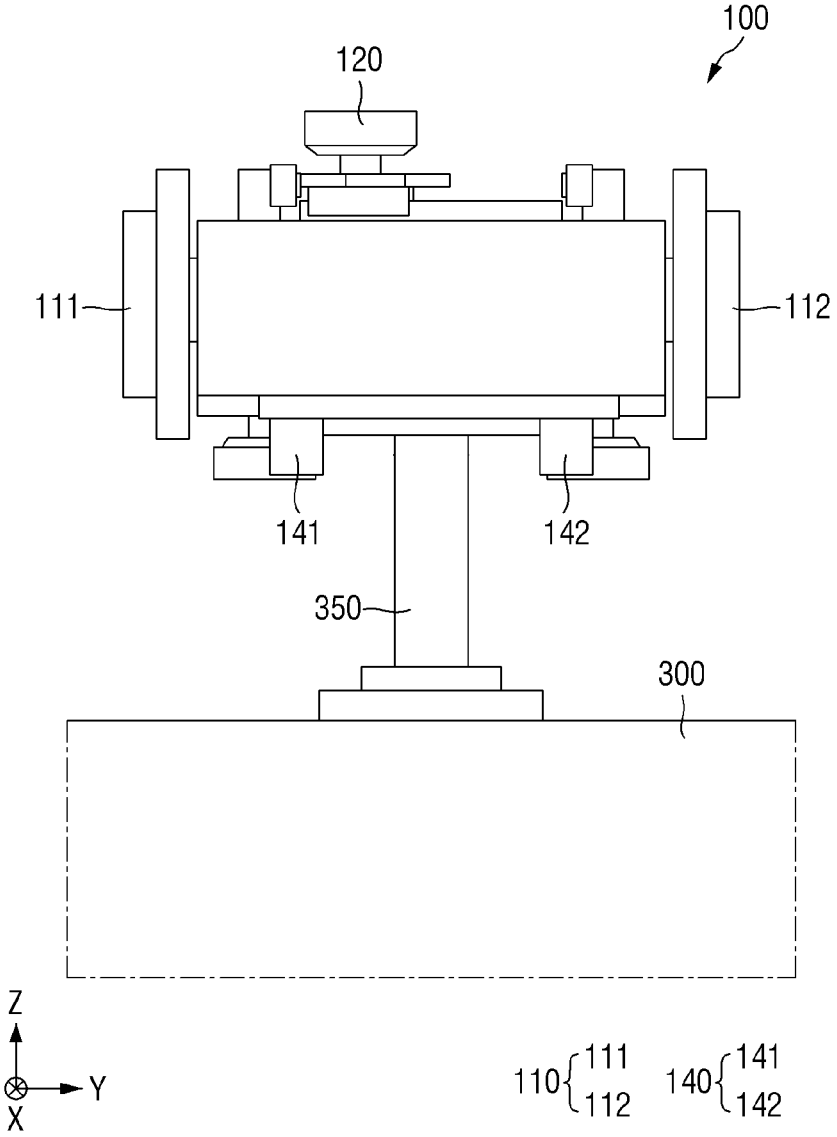
FIG. 3 is a side view illustrating a rail inspection device according to an example embodiment.
Figure 4:
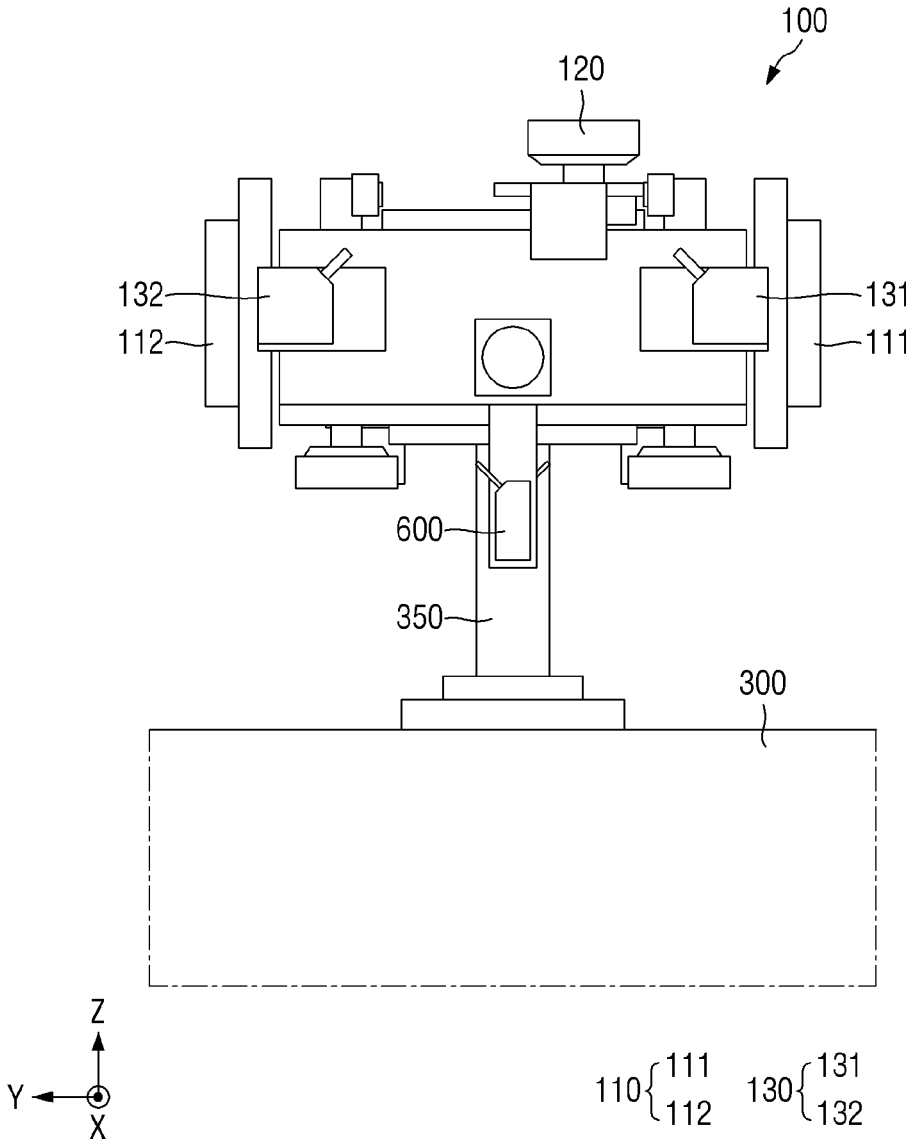
FIG. 4 is a side view illustrating the rail inspection device according to an example embodiment.
Figure 5:
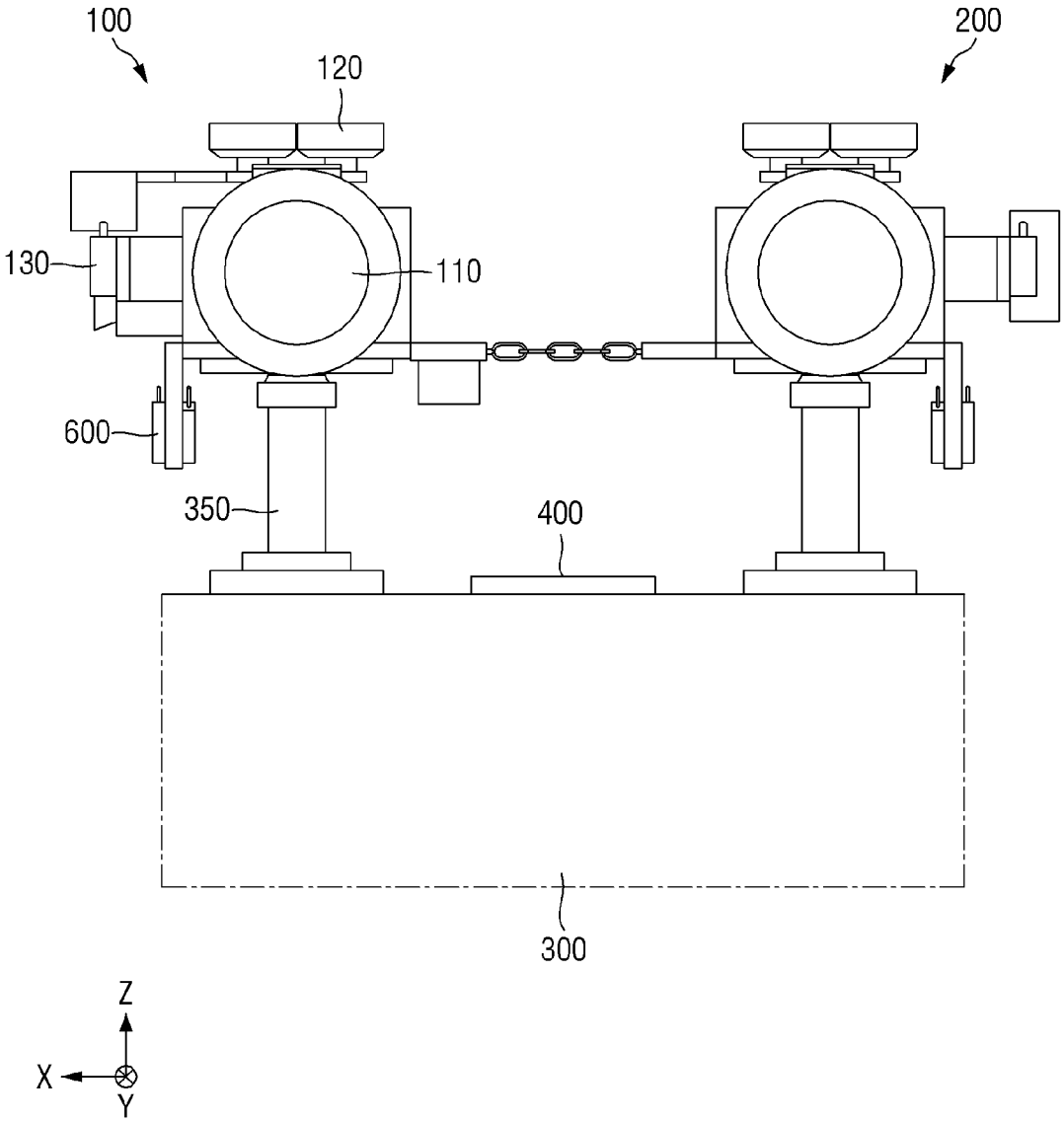
FIG. 5 is a side view illustrating the rail inspection device according to an example embodiment.

Hereinafter, various example embodiments of the disclosure will be described with reference to the attached FIG. 1 is a view illustrating a rail inspection device according to an example embodiment. FIG. 2 is a view illustrating a drive part of the rail inspection device according to an example embodiment. FIG. 3 is a side view illustrating a rail inspection device according to an example embodiment. FIG. 4 is a side view illustrating the rail inspection device according to an example embodiment. FIG. 5 is a side view illustrating the rail inspection device according to an example embodiment.

Referring to FIGS. 1 to 5, the rail inspection device 1 may include a first drive part 100, a second drive part 200, a body 300, an inclination sensor 400, an alarm display 500, a protrusion detection sensor 600, a camera 700, and a processor 10.

The rail inspection device 1 may include a plurality of drive parts 100. In FIG. 1, the rail inspection device 1 is illustrated to include two first drive parts 100 and a second drive part 200, but embodiments of the disclosure are not limited thereto. For example, the rail inspection device 1 may include one drive part. For example, the rail inspection device 1 may include three or more drive parts.

The first drive part 100 and the second drive part 200 may be spaced apart from each other in a first direction X. The first direction X in which the first drive part 100 and the second drive part 200 are spaced apart from each other may refer to a direction in which the rail inspection device 1 drives. The first drive part 100 and the second drive part 200 may be connected to each other via a connection device such as a loop.

Since the first drive part 100 and the second drive part 200 are substantially identical to each other, the first drive part 100 will be described below.

The first drive part 100 may be disposed above the body 300. The first drive part 100 may be connected to an upper surface of the body 300.

The first drive part 100 may include a side wheel 110, an upper wheel 120, a step sensor 130, and a width measurement sensor 140.

The first drive part 100 may drive in the first direction X. The side wheel 110 may rotate such that the first drive part 100 drives in the first direction X.

The side wheel 110 may include a first side wheel 111 and a second side wheel 112. The first side wheel 111 and the second side wheel 112 may be disposed on a side surface of the first drive part 100. The first side wheel 111 may be disposed on one side of the first drive part 100. The second side wheel 112 may be disposed on the other side opposite the one side of the first drive part 100. In other words, the first side wheel 111 and the second side wheel 112 may be disposed on opposite sides in a second direction Y intersecting the first direction X in which the first drive part 100 drives.

The upper wheel 120 may be disposed on an upper surface of the first drive part 100. The upper wheel 120 may rotate such that the first drive part 100 changes a driving direction. A location of the upper wheel 120 may be changed on the upper surface of the first drive part 100. For example, the location of the upper wheel 120 may be changed in the second direction Y along an upper axis 125 disposed on the upper surface of the first drive part 100. The location of the upper wheel 120 may be changed using, for example, a solenoid method.

The step sensor 130 may be disposed on a front surface of the first drive part 100. Specifically, the step sensor 130 may be disposed on a side surface of the first drive part 100 perpendicular to the first direction X in which the first drive part 100 moves.

The step sensor 130 may be installed to protrude from the front surface of the first drive part 100. Accordingly, the step sensor 130 may measure a distance in the third direction Z to the rail on which the first drive part 100 moves, ahead of the first drive part 100.

The step sensor 130 may include a first step measurer 131 and a second step measurer 132. The first step measurer 131 and the second step measurer 132 may be disposed at opposite ends of the front surface of the first drive part 100. For example, the first step measurer 131 may be disposed at one end of the front surface of the first drive part 100. The second step measurer 132 may be disposed at the other end of the front surface of the first drive part 100.

The first step measurer 131 may be disposed adjacent to the first side wheel 111. The second step measurer 132 may be disposed adjacent to the second side wheel 112.

The first step measurer 131 may measure a distance to a lower rail on which the first side wheel 111 moves. The second step measurer 132 may measure a distance in a third direction Z to the lower rail on which the second side wheel 112 moves. In this case, the third direction Z may refer to a direction perpendicular to both the first direction X and the second direction Y. For example, the third direction Z may refer to a direction perpendicular to an upper surface of the first drive part 100.

The width measurement sensor 140 may be disposed on a rear surface of the first drive part 100. The width measurement sensor 140 may be connected to a lower portion of the rear surface of the first drive part 100. In FIGS. 1 to 3, the width measurement sensor 140 is illustrated as being disposed at the lower portion of the rear surface of the first drive part 100, but embodiments of disclosure are not limited thereto. For example, the width measurement sensor 140 may be disposed on the front surface of the first drive part 100.

The width measurement sensor 140 may include a first width measurer 141 and a second width measurer 142. The first width measurer 141 and the second width measurer 142 may be disposed at opposite lower ends of the rear surface of the first drive part 100. For example, the first width measurer 141 may be connected to a lower portion of one end of the rear surface of the first drive part 100. The second width measurer 142 may be connected to a lower portion of the other end of the rear surface of the first drive part 100.

The first width measurer 141 may be disposed adjacent to the first side wheel 111. The second width measurer 142 may be disposed adjacent to the second side wheel 112.

The width measurement sensor 140 may not overlap with the side wheel 110. Specifically, the first width measurer 141 may not overlap with the first side wheel 111. The first width measurer 141 may not overlap with the first side wheel 111 in the first direction X, the second direction Y, and the third direction Z. The second width measurer 142 may not overlap with the second side wheel 112. The second width measurer 142 may not overlap with the second side wheel 112 in the first direction X, the second direction Y, and the third direction Z.

The width measurement sensor 140 may measure a distance in the second direction Y to the lower rail on which the side wheel 110 moves. The width measurement sensor 140 may provide the width detection signal to the processor 10 when a distance between the lower rail and the width measurement sensor 140 deviates from a threshold range (e.g., a first threshold range).

The body 300 may be disposed under the first drive part 100. The body 300 may be connected to a lower surface of the first drive part 100. A connection unit 350 may be disposed between the body 300 and the first drive part 100. In other words, the body 300 and the first drive part 100 may be connected to each other in the third direction Z via the connection unit 350.

The body 300 may move according to driving of the first drive part 100.

The connection unit 350 may be disposed on the upper surface of the body 300. The connection unit 350 may be disposed in the center of the upper surface of the body 300 in the second direction Y. The connection unit 350 may be disposed on a lower surface of the first drive part 100.

The inclination sensor 400 may be disposed on the upper surface of the body 300. The inclination sensor 400 may be disposed between the first drive part 100 and the second drive part 200 on the upper surface of the body 300. In FIGS. 1 and 5, the inclination sensor 400 is illustrated as being disposed between the first drive part 100 and the second drive part 200 in the first direction X. In FIGS. 1 and 5, the inclination sensor 400 is illustrated as being disposed between the first drive part 100 and the second drive part 200 in the first direction X, but embodiments of the disclosure are not limited thereto. For example, the inclination sensor 400 may be disposed ahead of the first drive part 100 in the first direction X. The inclination sensor 400 may be disposed behind the second drive part 200 in the first direction X.

The inclination sensor 400 may measure an inclination of the body 300. Specifically, the inclination sensor 400 may measure the inclination of the body 300 in the first direction X. The inclination sensor 400 may measure the inclination of the body 300 in the second direction Y. The inclination sensor 400 may provide an inclination detection signal to the processor 10 when the inclination of the body 300 is higher than or equal to the threshold value.

The alarm display 500 may be disposed on the body 300. For example, the alarm display 500 may be disposed on a side surface of the body 300. For example, the alarm display 500 may be disposed on a lower surface of the body 300.

The alarm display 500 may display a warning alarm according to measured values of the step sensor 130, the width measurement sensor 140, the inclination sensor 400, and a protrusion detection sensor 600. The warning alarm may include a visual alarm such as a light display or an acoustic alarm such as a warning sound.

For example, when a stepped portion of the lower rail detected by the step sensor 130 in the third direction Z deviates from a threshold range (e.g., a second threshold range), the alarm display 500 may display a warning alarm for the step of the lower rail.

As another example, when a width of the lower rail measured by the width measurement sensor 140 in the second direction Y deviates from the threshold range, the alarm display 500 may display a warning alarm for the width of the lower rail.

As another example, when an inclination of the rail inspection device 1 measured by the inclination sensor 400 deviates from the threshold range, the alarm display 500 may display a warning alarm for the inclination of the rail inspection device 1.

As another example, when a protrusion detection sensor 600 detects a protruding object, the alarm display 500 may display a warning alarm for the protruding object.

The alarm display 500 is connected to the processor 10. The alarm display 500 may operate in response to control of the processor 10 according to detection signals of the step sensor 130, the width measurement sensor 140, the inclination sensor 400, and the protrusion detection sensor 600.

The protrusion detection sensor 600 may be disposed on the front surface of the first drive part 100. Specifically, the protrusion detection sensor 600 may be disposed on the side surface of the first drive part 100 perpendicular to the first direction X in which the first drive part 100 drives. The protrusion detection sensor 600 may be connected to a lower portion of the front surface of the first drive part 100. The protrusion detection sensor 600 may protrude under the lower surface of the first drive part 100.

The protrusion detection sensor 600 may overlap with the connection unit 350 (see, e.g., FIG. 4). Specifically, the protrusion detection sensor 600 may overlap with the connection unit 350 in the first direction X. The protrusion detection sensor 600 may be disposed in the center of the first drive part 100 in the second direction Y.

The protrusion detection sensor 600 may detect an object protruding toward the protrusion detection sensor 600 from the lower portion of the lower rail on which the side wheel 110 drives. For example, the protrusion detection sensor 600 may detect the protruding object by measuring a distance to the protruding object using a laser. For example, the protrusion detection sensor 600 may detect the protruding object when the protrusion detection sensor 600 is in direct contact with the protruding object.

In FIGS. 1, 4, and 5, the protrusion detection sensor 600 is illustrated as being disposed on the front surface of the first drive part 100, but embodiments of the disclosure are not limited thereto. For example, the protrusion detection sensor 600 may be disposed on the rear surface of the first drive part 100. The protrusion detection sensor 600 may be connected to the lower portion of the rear surface of the first drive part 100.

The camera 700 may be disposed on the front surface of the first drive part 100. The camera 700 may capture an image a surrounding environment (e.g., a driving environment) in which the first drive part 100 drives.

The processor 10 may control an overall operation of the rail inspection device 1. The processor 10 may control the step sensor 130, the width measurement sensor 140, the inclination sensor 400, the alarm display 500, and the protrusion detection sensor 600.

The processor 10 may control the alarm display 500 to display the warning alarm in response to a step detection signal provided by the step sensor 130. The processor 10 may control the alarm display 500 to display the warning alarm in response to a width detection signal provided by the width measurement sensor 140. The processor 10 may control the alarm display 500 to display the warning alarm in response to the inclination detection signal provided by the inclination sensor 400. The processor 10 may control the alarm display 500 to display the warning alarm in response to a protrusion detection signal provided by the protrusion detection sensor 600.

The processor 10 may control the step sensor 130 to measure a distance between the lower rail 915 and the step sensor 130 in response to the inclination detection signal provided by the inclination sensor 400.

Figure 6:
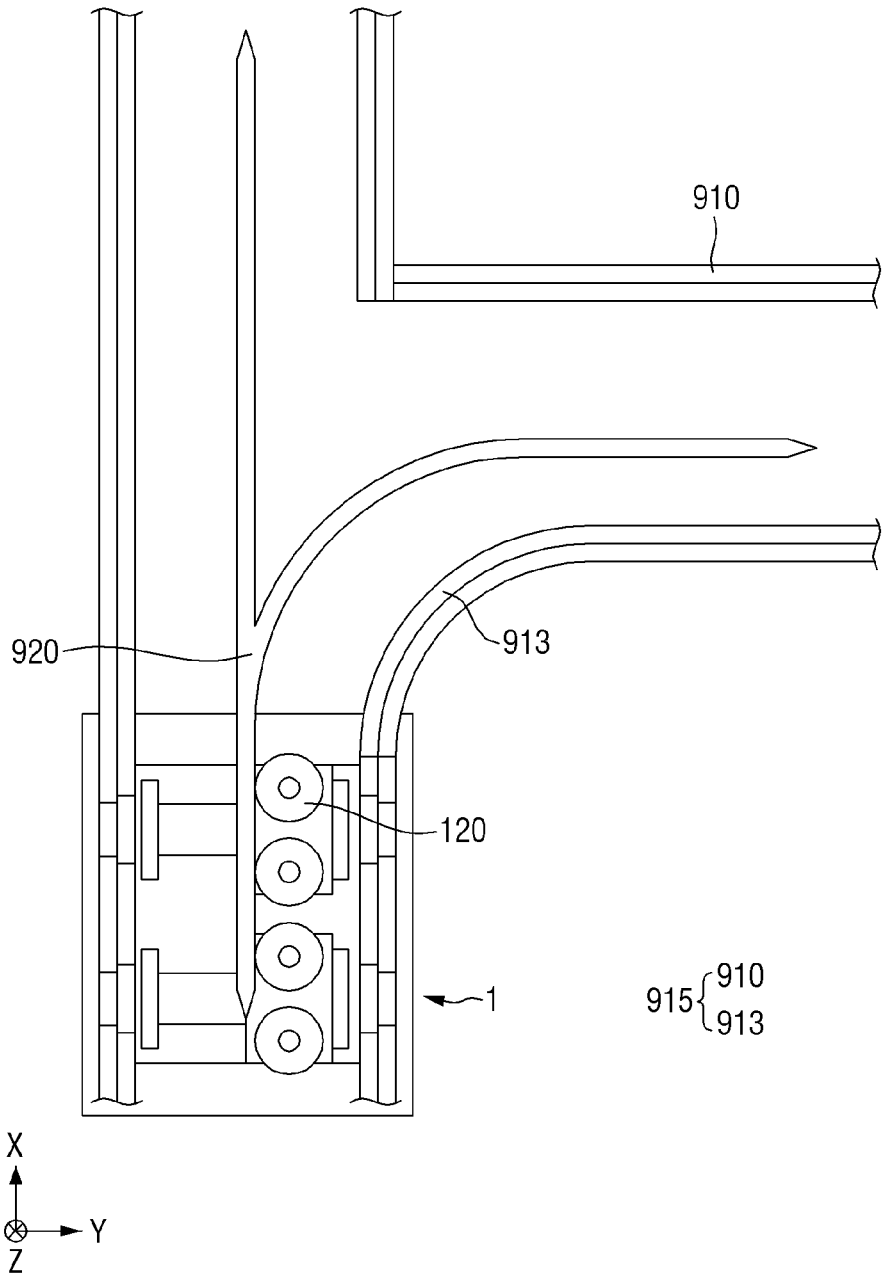
FIG. 6 is a view illustrating a rail for describing the rail inspection device according to an example embodiment.
Figure 7:
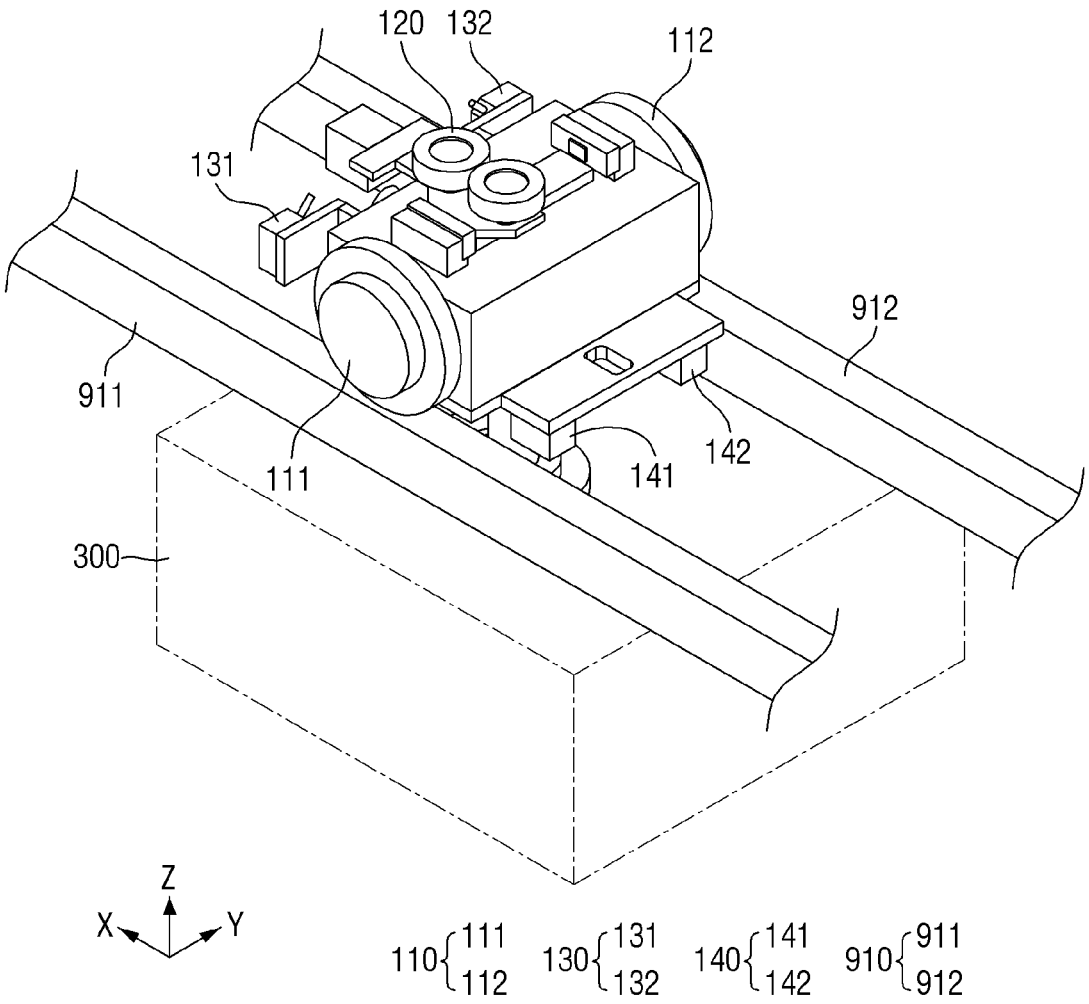
FIG. 7 is a view illustrating the rail inspection device according to an example embodiment.

FIG. 6 is a view illustrating a rail for describing the rail inspection device according to an example embodiment. FIG. 7 is a view illustrating the rail inspection device according to an example embodiment.

Referring to FIGS. 6 and 7, the rail inspection device 1 may move on a rail. The rail on which the rail inspection device 1 moves may include a lower rail 915 and a branch guide rail 920. The lower rail 915 may include a straight rail 910 and a branch rail 913.

When the rail inspection device 1 moves on the lower rail 915, the lower rail 915 may be disposed between the first drive part 100 and the body 300 in the third direction Z and between the second drive part 200 and the body 300 in the third direction Z.

The straight rail 910 may include a first straight rail 911 (e.g., a first lower rail) and a second straight rail 912 (e.g., a second lower rail). The first straight rail 911 and the second straight rail 912 may be spaced apart from each other and extend in parallel. For example, as illustrated in FIG. 7, the first straight rail 911 and the second straight rail 912 may be spaced apart from each other in the second direction Y and may extend in the first direction X, respectively.

The side wheel 110 of the rail inspection device 1 may rotate on the straight rail 910. For example, the first side wheel 111 may rotate on the first straight rail 911. The second side wheel 112 may rotate on the second straight rail 912. As the side wheel 110 rotates on the straight rail 910, the rail inspection device 1 may move.

When changing the driving direction of the rail inspection device 1, the side wheel 110 may move on the branch rail 913. For example, when the rail inspection device 1 changes the driving direction to the right while driving straight, the side wheel 110 of the rail inspection device 1 may move on the branch rail 913 disposed on the right of the driving direction. For example, when the rail inspection device 1 changes the driving direction to the left while driving straight, the side wheel 110 of the rail inspection device 1 may move on the branch rail 913 disposed on the left of the driving direction.

The branch guide rail 920 may be disposed above the rail inspection device 1. The branch guide rail 920 may support the upper wheel 120 when changing the driving direction of the rail inspection device 1. When changing the driving direction of the rail inspection device 1, the upper wheel 120 may rotate on the branch guide rail 920. The upper wheel 120 may rotate in contact with a side surface of the branch guide rail 920 (see, e.g., FIG. 6).

Figure 8:
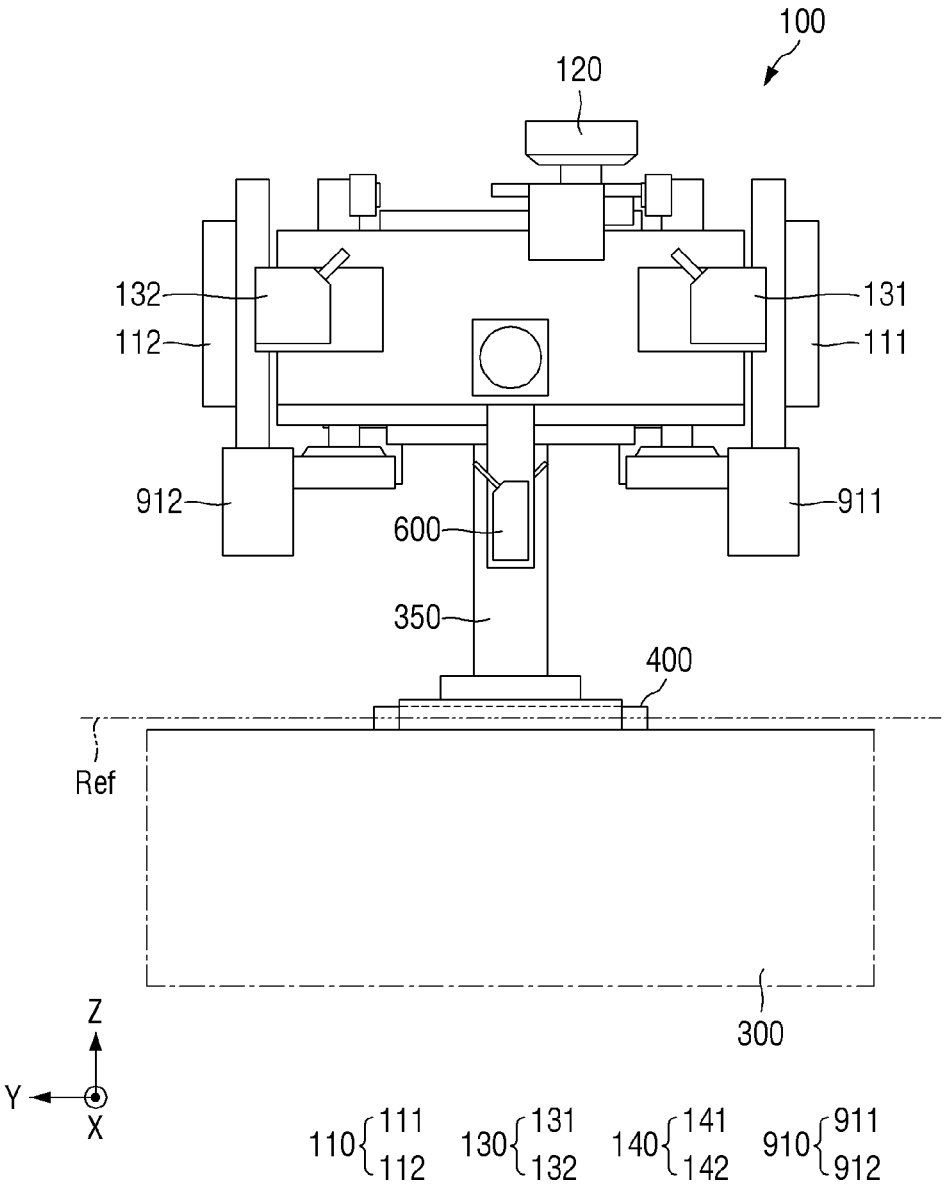
FIG. 8 is a view illustrating the inclination sensor of the rail inspection device according to an example embodiment.
Figure 9:
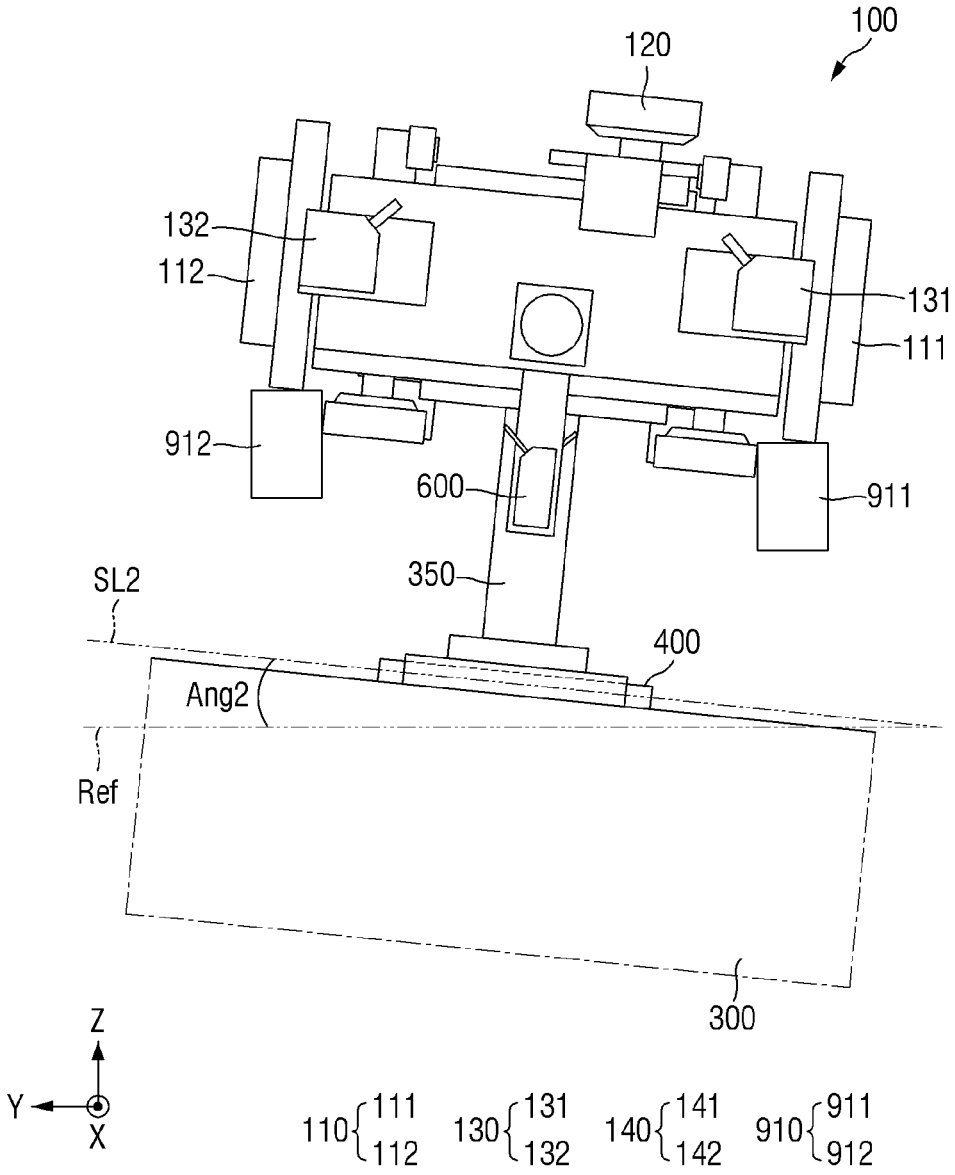
FIG. 9 is a view illustrating the inclination sensor of the rail inspection device according to an example embodiment.
Figure 10:
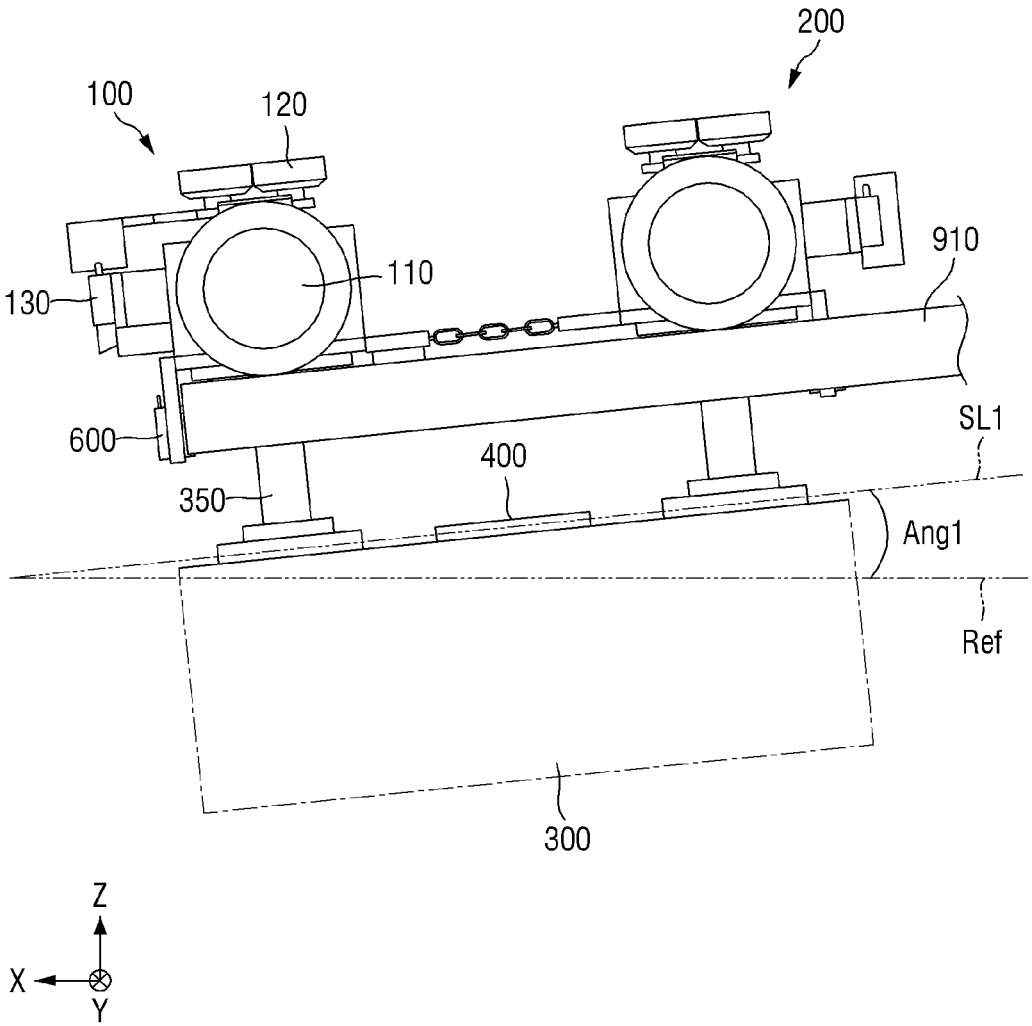
FIG. 10 is a view illustrating the inclination sensor of the rail inspection device according to an example embodiment.

FIGS. 8, 9 and 10 are view illustrating the inclination sensor of the rail inspection device according to example embodiments of the disclosure.

Referring to FIG. 8, the inclination sensor 400 may measure an inclination of the body 300. Specifically, the inclination sensor 400 may measure the inclination of the body 300 with respect to a reference Ref. The reference Ref may be set depending on a design specification of the rail inspection device 1.

When the side wheel 110 moves on the straight rail 910, the inclination sensor 400 may measure the inclination of the body 300 in the second direction Y. In this case, the second direction Y may refer to a direction in which the first straight rail 911 and the second straight rail 912 are spaced apart from each other.

When the first side wheel 111 rotates in contact with the first straight rail 911 and the second side wheel 112 rotates in contact with the second straight rail 912, the inclination of the body 300 measured by the inclination sensor 400 may coincide with the reference Ref. When the inclination of the body 300 coincides with the reference Ref, the first straight rail 911 and the second straight rail 912 may be balanced in the third direction Z. In other words, the height of the first straight rail 911 in the third direction Z may coincide with the height of the second straight rail 912 in the third direction Z.

Referring to FIG. 9, when the first side wheel 111 rotates in contact with the first straight rail 911 and the second side wheel 112 rotates in contact with the second straight rail 912, the inclination of the body 300 measured by the inclination sensor 400 in the second direction Y may have a second inclination SL2 with respect to the reference Ref. The inclination of the body 300 measured by the inclination sensor 400 in the second direction Y may have a second angle Ang2 between the inclination and the reference Ref.

For example, when the second angle Ang2 is 0, the second inclination SL2 may coincide with the reference Ref. In other words, when the second angle Ang2 is 0, the body 300 may be balanced in the second direction Y.

The straight rail 910 may be unbalanced in the second direction Y. In other words, the straight rail 910 may be inclined in the second direction Y. In this case, the second inclination SL2 of the body 300 measured by the inclination sensor 400 in the second direction Y fails to coincide with the reference Ref. The second angle Ang2 of the body 300 between the second inclination SL2 and the reference Ref in the second direction Y may not be 0.

For example, the height of the first straight rail 911 in the third direction Z and the height of the second straight rail 912 in the third direction Z may be different from each other in the second direction Y. In this case, the heights of the first side wheel 111 contacting the first straight rail 911 and the second side wheel 112 contacting the second straight rail 912 in the third direction Z may be different from each other. Accordingly, the first drive part 100 may be inclined in the second direction Y. The body 300 connected to the inclined first drive part 100 may also have an inclination different from that of the reference Ref in the second direction Y.

Referring to FIG. 10, when the side wheel 110 moves on the straight rail 910, the inclination sensor 400 may measure the inclination of the body 300 in the first direction X. In this case, the first direction X may refer to a direction in which the first straight rail 911 and the second straight rail 912 extend.

The inclination of the body 300 measured by the inclination sensor 400 in the first direction X may have a first inclination SL1 with respect to the reference Ref. The inclination of the body 300 measured by the inclination sensor 400 in the first direction X may have a first angle Ang1 between the inclination and the reference Ref.

For example, when the first angle Ang1 is 0, the first inclination SL1 may coincide with the reference Ref. In other words, when the first angle Ang1 is 0, the body 300 may be balanced in the first direction X.

The straight rail 910 may be unbalanced in the first direction X. In other words, the straight rail 910 may be inclined in the first direction X. In this case, the first inclination SL1 of the body 300 measured by the inclination sensor 400 in the first direction X fails to coincide with the reference Ref. The first angle Ang1 of the body 300 between the first inclination SL1 and the reference Ref in the first direction X may not be 0.

For example, the heights of the straight rail 910 on which the first drive part 100 moves and the straight rail 910 on which the second drive part 200 moves in the third direction Z may be different from each other in the first direction X. Since the straight rail 910 is inclined in the first direction X, the first drive part 100 and the second drive part 200 that move in the straight rail 910 may also be inclined in the first direction X. The body 300 connected to the first drive part 100 and the second drive part 200 inclined in the first direction X may also have an inclination different from that of the reference Ref in the first direction X.

Figure 11:
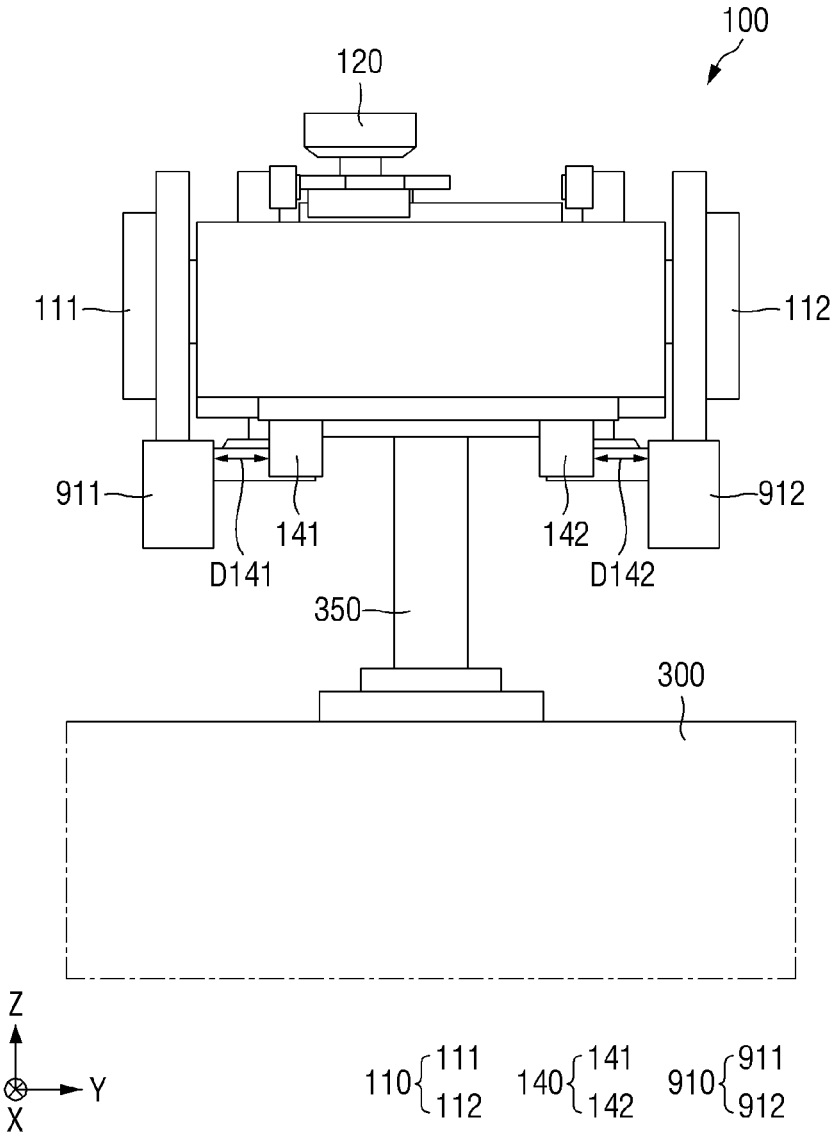
FIG. 11 is a view illustrating the width measurement sensor of the rail inspection device according to an example embodiment.

FIG. 11 is a view illustrating the width measurement sensor of the rail inspection device according to an example embodiment.

Referring to FIG. 11, when the first drive part 100 moves on the straight rail 910, the width measurement sensor 140 may measure a distance to the straight rail 910. The width measurement sensor 140 may measure a distance from the width measurement sensor 140 to the straight rail 910 in the second direction Y using a laser (e.g., a first laser).

Specifically, the first width measurer 141 may measure a first distance D141 to the first straight rail 911 on which the first side wheel 111 moves. The second width measurer 142 may measure a second distance D142 to the second straight rail 912 on which the second side wheel 112 moves.

Figure 12:
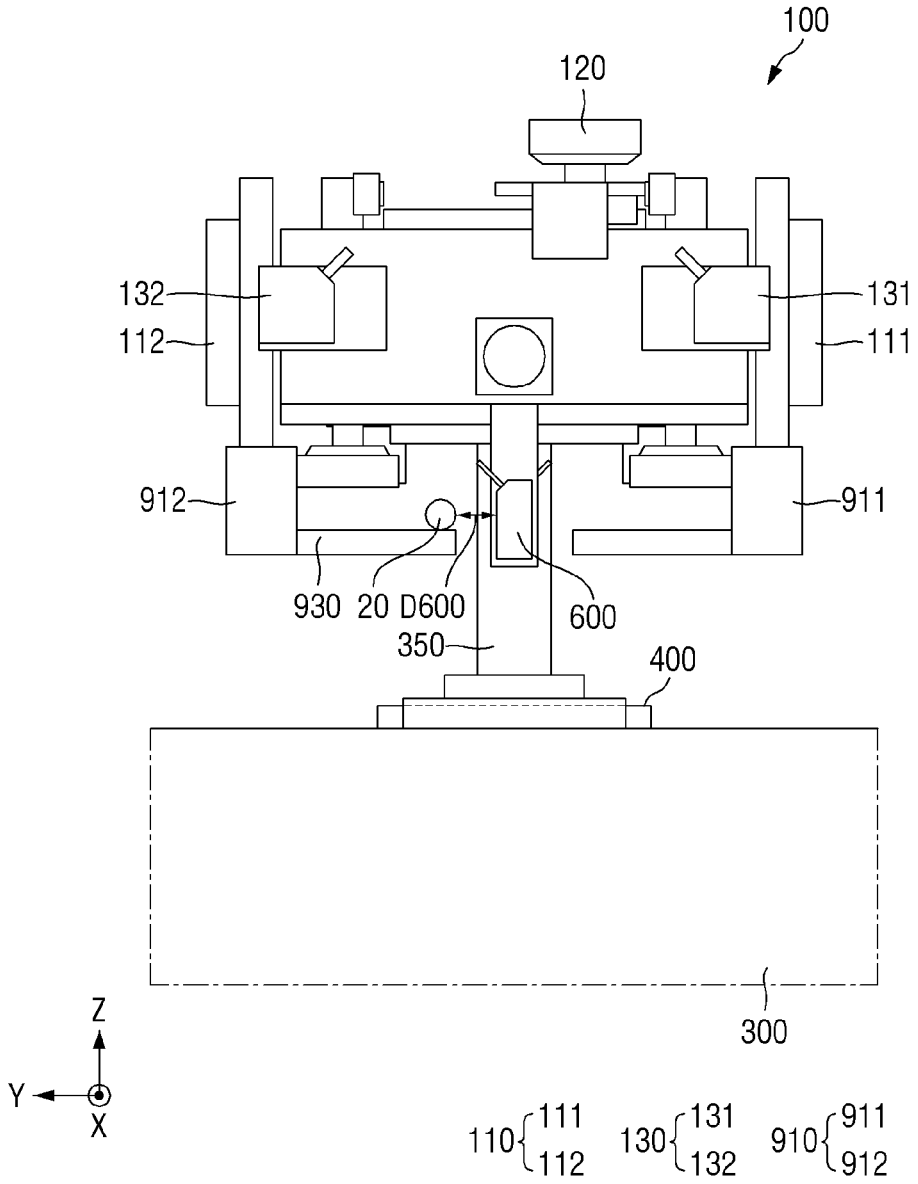
FIG. 12 is a view illustrating the protrusion detection sensor of the rail inspection device according to an example embodiment.

FIG. 12 is a view illustrating the protrusion detection sensor of the rail inspection device according to an example embodiment.

Referring to FIG. 12, the protrusion detection sensor 600 may detect the object protruding toward the protrusion detection sensor 600. For example, the protrusion detection sensor 600 may detect a non-contact power supply wiring separated from an auxiliary tray 930. For example, the protrusion detection sensor 600 may detect the protruding object that may interfere with the driving of the rail inspection device 1.

The protrusion detection sensor 600 may measure a distance D600 between a protruding object 20 and the protrusion detection sensor 600. For example, the protrusion detection sensor 600 may measure a distance D600 between the protruding object 20 and the protrusion detection sensor 600 using a laser.

When the distance D600 between the protruding object 20 and the protrusion detection sensor 600 is less than the threshold value, the protrusion detection sensor 600 may provide the protrusion detection signal to the processor 10.

The processor 10 may control the alarm display 500 to display the warning alarm in response to receiving the protrusion detection signal from the protrusion detection sensor 600.

Figure 13:
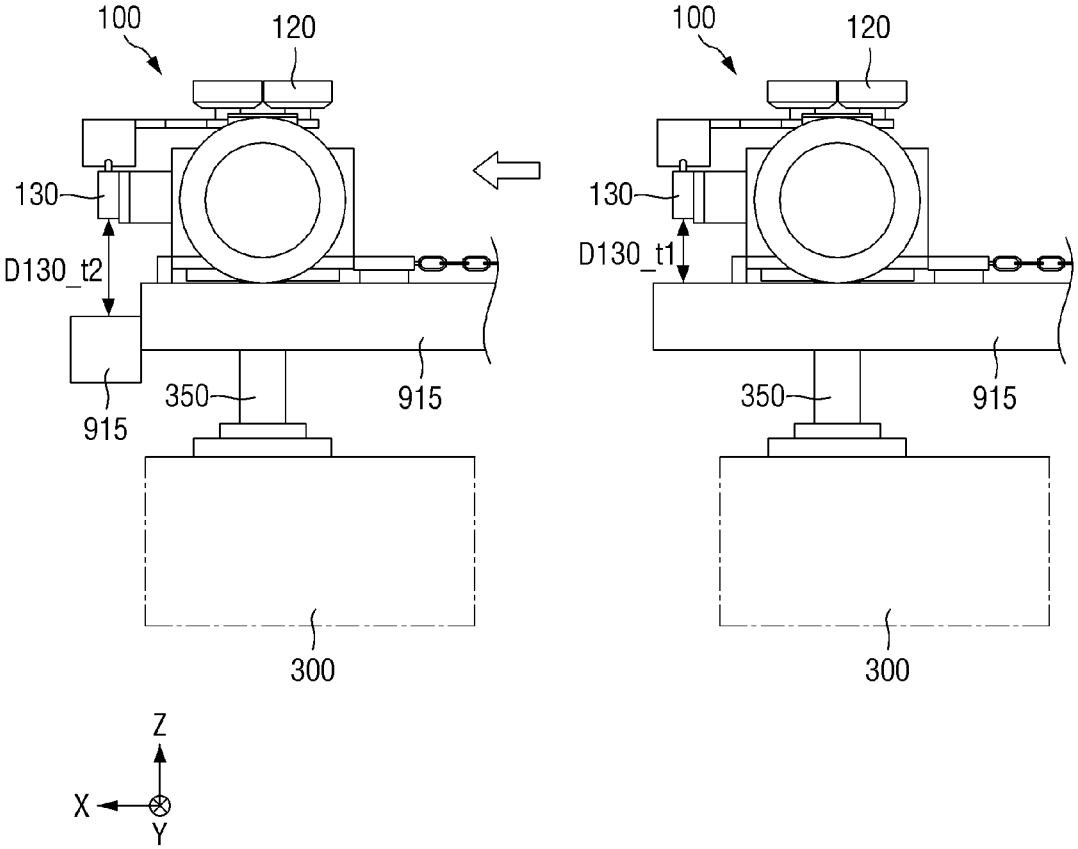
FIG. 13 is a view illustrating the step sensor of the rail inspection device according to an example embodiment.

FIG. 13 is a view illustrating the step sensor of the rail inspection device according to an example embodiment.

Referring to FIG. 13, the step sensor 130 may measure a distance to a lower rail 915 on which the first drive part 100 moves. Specifically, the step sensor 130 may measure a distance from the step sensor 130 to the lower rail 915 in the third direction Z using a laser (e.g., a second laser).

The step sensor 130 may be disposed to protrude from the first drive part 100 in the first direction X (e.g., in the forward direction of movement of the rail inspection device 1). Accordingly, the step sensor 130 may measure a distance between the lower rail 915 and the step sensor 130 ahead of a path where the first drive part 100 moves along the lower rail 915.

The lower rail 915 may have a stepped portion. For example, the distance from the location of the first drive part 100 at a first time to the lower rail 915 measured by the step sensor 130 may be a third distance D130_*t*1. The distance from the location of the first drive part 100 at a second time after the first time to the lower rail 915 measured by the step sensor 130 may be a fourth distance D130_*t*2. In this case, the fourth distance D130_*t*2 may be higher than the third distance D130_*t*1.

When a change in the distance to the lower rail 915 is detected over time, the step sensor 130 may provide the step detection signal to the processor 10. When a change in the distance to the lower rail 915 is detected over time, a connection to the lower rail 915 may be unstable.

In addition, when the distance to the lower rail 915 deviates from the threshold range, the step sensor 130 may provide the step detection signal to the processor 10. When the distance to the lower rail 915 deviates from the threshold range, the lower rail 915 may be inclined in the first direction X.

For example, when the distance to the lower rail 915 is less than the threshold range to make the distance from the step sensor 130 close, the step sensor 130 may provide the step detection signal to the processor 10. For example, when the distance to the lower rail 915 exceeds the threshold range to make the distance from the step sensor 130 distant, the step sensor 130 may provide the step detection signal to the processor 10.

The processor 10 may control the alarm display 500 to display the warning alarm for a stepped portion of the lower rail 915 in response to the step detection signal of the step sensor 130.

FIG. 13 illustrates that the fourth distance D130_*t*2 is larger than the third distance D130_*t*1 in the first direction X in which the first drive part 100 moves, but embodiments of the disclosure are not limited thereto. For example, the fourth distance D130_*t*2 may be smaller than the third distance D130_*t*1.

Figure 14:
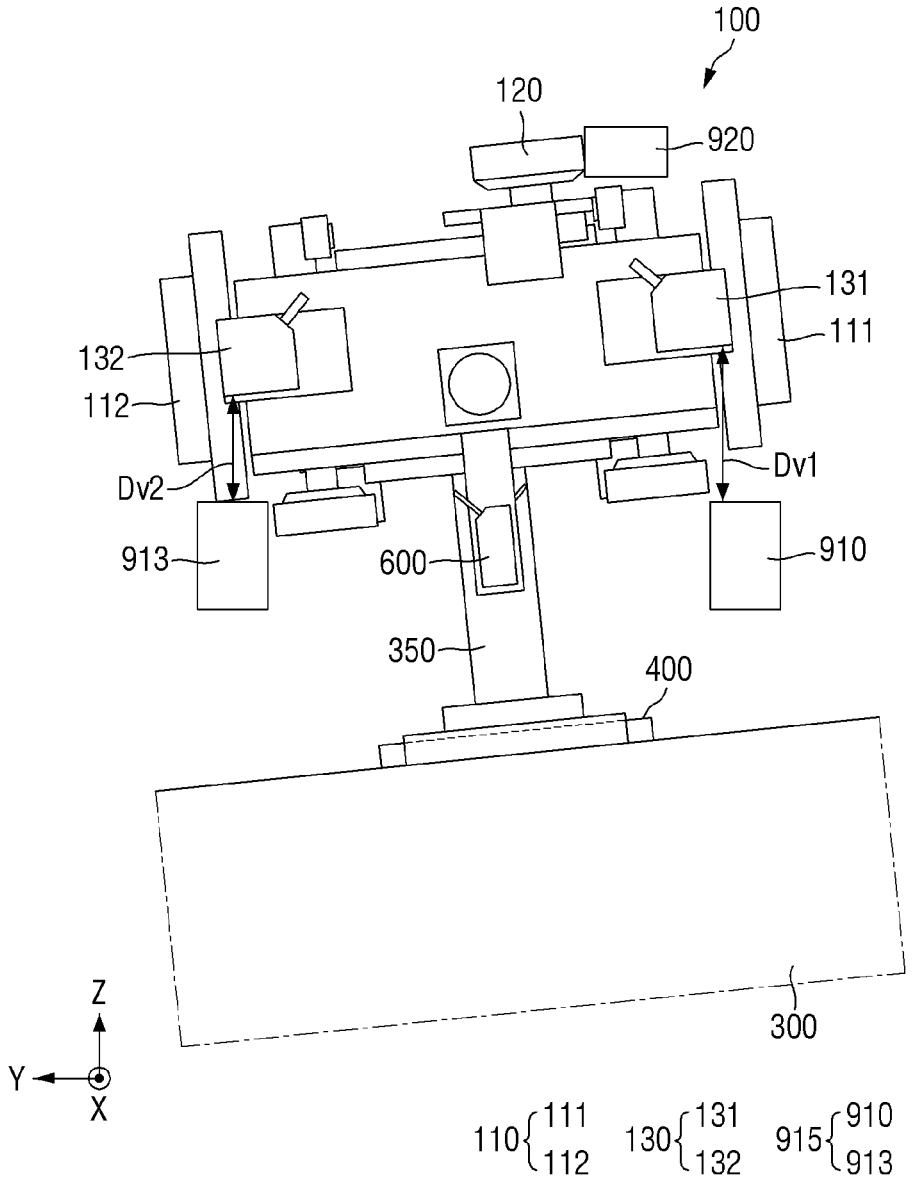
FIG. 14 is a view illustrating the step sensor of the rail inspection device according to an example embodiment.

FIG. 14 is a view illustrating the step sensor of the rail inspection device according to an embodiment of the disclosure.

Referring to FIG. 14, the first drive part 100 may be inclined in the second direction Y. Specifically, when the upper wheel 120 of the first drive part 100 moves in contact with a side surface of the branch guide rail 920, the first drive part 100 may be inclined in the second direction Y. When the first drive part 100 changes a direction along the branch rail 913 on the rail, the upper wheel 120 may be in contact with the side surface of the branch guide rail 920.

When the upper wheel 120 is in contact with the side surface of the branch guide rail 920, one of the side wheels 110 of the first drive part 100 may not be in contact with the lower rail 915. For example, when the upper wheel 120 is in contact with one side surface of the branch guide rail 920, the first side wheel 111 may not be in contact with the first straight rail 911. For example, when the upper wheel 120 is in contact with the other side surface of the branch guide rail 920, the second side wheel 112 may not be in contact with the second straight rail 912.

In other words, as the upper wheel 120 supports and rotates on the side surface of the branch guide rail 920, one of the first side wheel 111 and the second side wheel 112 is spaced apart from the lower rail 915.

As one of the side wheels 110 of the first drive part 100 is spaced apart from the lower rail 915, the first drive part 100 may be inclined in the second direction Y.

The step sensor 130 may measure a distance in the third direction Z to the lower rail 915. For example, the first step measurer 131 may measure a first vertical distance Dv1 to the straight rail 910. The second step measurer 132 may measure a second vertical distance Dv2 to the branch rail 913. When the first drive part 100 is inclined in the second direction Y, the first vertical distance Dv1 and the second vertical distance Dv2 may be different from each other.

A worker that uses the rail inspection device 1 may confirm a location of the branch guide rail 920 based on the distance to the lower rail 915 measured by the step sensor 130.

For example, when there is a small difference between the first vertical distance Dv1 to the straight rail 910 and the second vertical distance Dv2 to the branch rail 913 measured by the step sensor 130, the branch guide rail 920 may be disposed in a location incapable of supporting the upper wheel 120. In other words, the branch guide rail 920 may not support the upper wheel 120, and it may not be the case that one of the first side wheel 111 and the second side wheel 112 is completely spaced apart from the lower rail 915.

For example, when there is a large difference between the first vertical distance Dv1 to the straight rail 910 and the second vertical distance Dv2 to the branch rail 913 measured by the step sensor 130, the branch guide rail 920 may be disposed adjacent to the upper wheel 120 to support the upper wheel 120. In other words, one of the first side wheel 111 and the second side wheel 112 may be spaced apart from the lower rail 915 while the upper wheel 120 is in contact with the side surface of the branch guide rail 920. The branch guide rail 920 may support the upper wheel 120 to the extent that one of the first side wheel 111 and the second side wheel 112 is completely spaced apart from the lower rail 915.

Referring to FIGS. 9 and 14, the step sensor 130 may organically operate with the inclination sensor 400. For example, in response to the second inclination SL2 of the body 300 measured by the inclination sensor 400 that fails to coincide with the inclination of the reference Ref, the step sensor 130 may measure the distance between the lower rail 915 and the step sensor 130.

Specifically, the second inclination SL2 of the body 300 measured by the inclination sensor 400 in the second direction Y may mean that the first side wheel 111 floats from the lower rail 915. In other words, the upper wheel 120 may move along the side surface of the branch guide rail 920, the second side wheel 112 moves on the branch rail 913, and the first side wheel 111 may be spaced apart from the straight rail 910. In this case, the first step measurer 131 of the step sensor 130 may measure a distance between the lower rail 915 and the first step measurer 131.

The second inclination SL2 of the body 300 measured by the inclination sensor 400 in the second direction Y may mean that the second side wheel 112 floats from the lower rail 915.

In other words, the upper wheel 120 may move along the side surface of the branch guide rail 920, the first side wheel 111 moves on the branch rail 913, and the second side wheel 112 may be spaced apart from the straight rail 910. In this case, the second step measurer 132 of the step sensor 130 may measure a distance between the lower rail 915 and the second step measurer 132.

Figure 15:
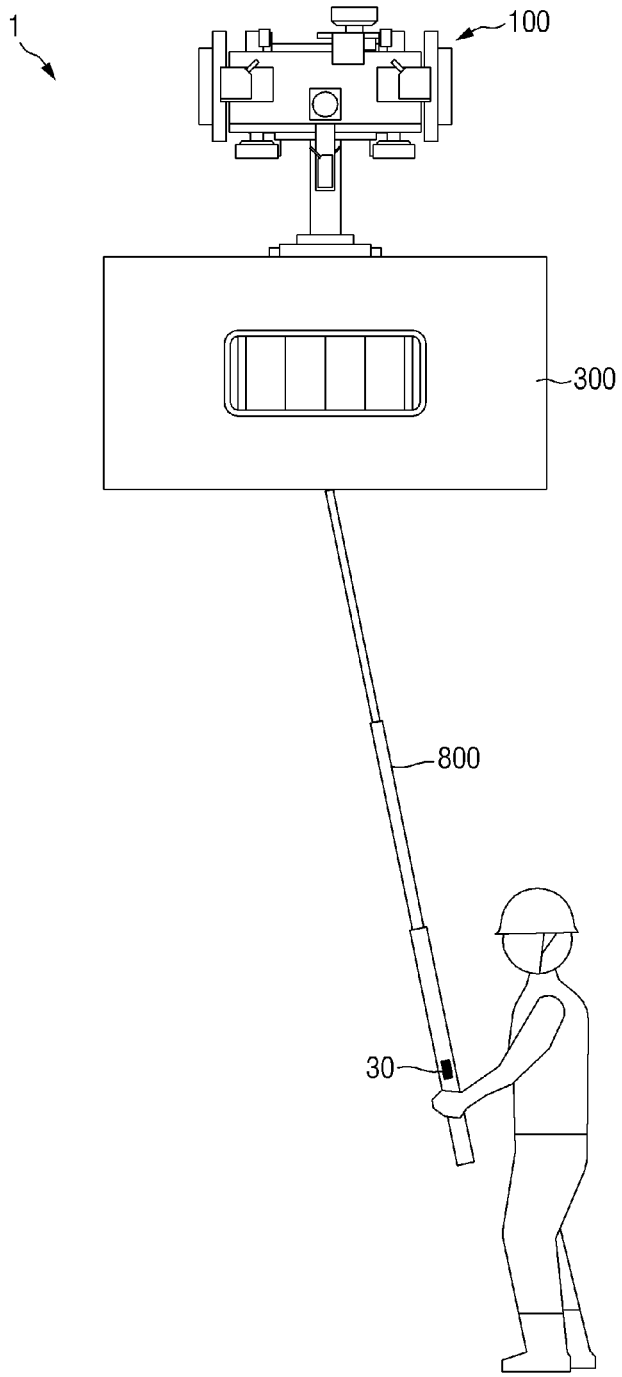
FIG. 15 is a view illustrating an operation bar of the rail inspection device according to an example embodiment.

FIG. 15 is a view illustrating an operation bar of the rail inspection device according to an example embodiment.

Referring to FIG. 15, the rail inspection device 1 may include an operation bar 800. The operation bar 800 may be removably attached to the rail inspection device 1. The operation bar 800 may be connected to the lower surface of the body 300. A manner in which the operation bar 800 is connected to the rail inspection device 1 may be variously changed according to embodiments. For example, the operation bar 800 may be hooked on the lower surface of the body 300 via the loop.

The location of the rail inspection device 1 may be adjusted by the attached operation bar 800. The worker may move the rail inspection device 1 on the rail using the operation bar 800.

The operation bar 800 may include a controller 30. The controller 30 may adjust the location of the upper wheel 120. For example, the controller 30 may control the location of the upper wheel 120 to be changed in the second direction Y along the upper axis 125 (see, e.g., FIG. 2). When the rail inspection device 1 changes the driving direction by supporting the branch rail 913 and the branch guide rail 920, the worker may adjust the location of the upper wheel 120 to move on the side surface of the branch guide rail 920 using the controller 30.

The controller 30 may control an operation of the camera 700. For example, the controller 30 may switch the camera 700 on/off.

When the operation bar 800 is attached to the rail inspection device 1, the controller 30 may be connected to the rail inspection device 1 in a wired manner, but embodiments are not limited thereto. For example, the controller 30 may be wirelessly connected to the rail inspection device 1.

Those skilled in the art will appreciate that many variations and modifications may be made to the example embodiments without substantially departing from the principles of the disclosure. Therefore, the example embodiments of the disclosure are used in a generic and descriptive sense only and not for purposes of limitation.

What is claimed is:

1. A rail inspection device comprising:

a drive part configured to drive on a lower rail;

side wheels configured to rotate such that the drive part moves in a first direction on the lower rail, wherein the side wheels are on two side surfaces of the drive part opposite in a second direction that intersects the first direction;

upper wheels on an upper surface of the drive part and configured to rotate in contact with a branch guide rail above an upper portion of the drive part;

a body connected to a lower surface of the drive part in a third direction that is perpendicular to the first direction and the second direction;

an inclination sensor on an upper surface of the body and configured to measure an inclination of the body; and a step sensor on a front surface of the drive part and configured to detect whether a front portion of the lower rail in a driving direction of the drive part is continuous or discontinuous and to identify a stepped portion of the lower rail based on the detected discontinuity, wherein the step sensor is further configured to measure a distance to the stepped portion of the lower rail from the step sensor in the third direction using a laser.

2. The rail inspection device of claim 1, further comprising:

a object detection sensor connected to a lower portion of the drive part and configured to generate a object detection signal based on a protruding object being detected; and an alarm display on the body and configured to display a warning alarm for the protruding object based on the protruding-object detection signal of the protruding-object detection sensor.

3. The rail inspection device of claim 2, wherein the protruding-object detection sensor is further configured to generate the protruding-object detection signal based on the protruding object being in contact with the protruding-object detection sensor.

4. The rail inspection device of claim 2, wherein the protruding-object detection sensor is further configured to measure a distance between the protruding object and the protruding-object detection sensor using a laser, and to generate the protruding-object detection signal based on the distance between the protruding object and the protruding-object detection sensor being less than or equal to a threshold value determined based on a rail design specification.

5. The rail inspection device of claim 1, wherein the inclination sensor is further configured to measure a first inclination of the body in the first direction and a second inclination of the body in the second direction.

6. The rail inspection device of claim 1, further comprising:

a width measurement sensor on a rear surface of the drive part and configured to measure to a distance to the lower rail from the width measurement sensor in the second direction using a laser, and generate a width detection signal based on the distance to the lower rail deviating from a threshold range determined based on a rail design specification; and an alarm display on the body and configured to display a warning alarm for the distance to the lower rail based on the width detection signal.

7. The rail inspection device of claim 1, wherein the lower rail comprises a first lower rail and a second lower rail, wherein the side wheels comprise a first side wheel on a first side of the drive part and a second side wheel on a second side opposite the first side, wherein the step sensor comprises a first step measurer adjacent to the first side wheel and a second step measurer adjacent to the second side wheel, wherein the first step measurer and the second step measurer are respectively at opposite ends of the front surface of the drive part, wherein the first step measurer is configured to detect whether a front portion of the first lower rail in the driving direction of the drive part is continuous or discontinuous and to identify a first stepped portion of the first lower rail based on the detected discontinuity of the first lower rail, wherein the second step measurer is configured to detect whether a front portion of the second lower rail in the driving direction of the drive part is continuous or discontinuous and to identify a second stepped portion of the second lower rail based on the detected discontinuity of the second lower rail, wherein the first step measurer is further configured to measure a distance between the first lower rail on which the first side wheel moves and the first step measurer, and wherein the second step measurer is further configured to measure a distance between the second lower rail on which the second side wheel moves and the second step measurer.

8. The rail inspection device of claim 1, further comprising an alarm display on the body and configured to display a warning alarm, wherein the inclination sensor is further configured to generate an inclination detection signal based on the inclination of the body being greater than or equal to a threshold value determined based on a rail design specification, and wherein the alarm display is further configured to generate the warning alarm for the inclination of the body based on the inclination detection signal.

9. The rail inspection device of claim 1, further comprising:

a camera in the drive part and configured to capture an image of a driving environment of the drive part;

an operation bar removably attached to the body and configured to manually adjust a position or orientation of the body; and a controller in the operation bar and configured to change a location of the upper wheels and control an operation of the camera.

10. The rail inspection device of claim 1, wherein a plurality of drive parts, including the drive part, are provided on the body.

11. A rail inspection device comprising:

a drive part configured to drive on a lower rail;

side wheels configured to rotate such that the drive part moves in a first direction on the lower rail, wherein the side wheels are on two side surfaces of the drive part opposite in a second direction that intersects the first direction;

upper wheels on an upper surface of the drive part and configured to rotate in contact with a branch guide rail above an upper portion of the drive part as part of an external guide rail;

a body connected to a lower surface of the drive part in a third direction that is perpendicular to the first direction and the second direction;

an inclination sensor on an upper surface of the body, and configured to measure an inclination of the body in the second direction and to generate an inclination detection signal based on the inclination being greater than or equal to a threshold value determined based on a rail design specification; and a step sensor on a front surface of the drive part and configured to detect whether a front portion of the lower rail in a driving direction of the drive part is continuous or discontinuous and to identify a stepped portion of the lower rail based on the detected discontinuity, wherein the step sensor is further configured to measure a distance to the stepped portion of the lower rail from the step sensor in the third direction based on the inclination detection signal.

12. The rail inspection device of claim 11, wherein the lower rail comprises a first lower rail and a second lower rail, wherein the side wheels comprise a first side wheel provided on a first side of the drive part and a second side wheel on a second side of the drive part opposite the first side, wherein the step sensor comprises a first step measurer adjacent to the first side wheel and a second step measurer adjacent to the second side wheel, wherein the first step measurer and the second step measurer are respectively at opposite ends of the front surface of the drive part, wherein the first step measurer is configured to measure a distance between the first lower rail on which the first side wheel moves and the first step measurer based on the inclination detection signal indicating that the first side wheel floats from the lower rail, and wherein the second step measurer is configured to measure a distance between the second lower rail on which the second side wheel moves and the second step measurer based on the inclination detection signal indicating that the second side wheel floats from the lower rail.

13. The rail inspection device of claim 11, further comprising a protruding-object detection sensor connected to a lower portion of the drive part and configured to detect a protruding object.

14. The rail inspection device of claim 11, further comprising a width measurement sensor on a rear surface of the drive part, and configured to measure a distance to the lower rail from the width measurement sensor in the second direction using a laser.

15. The rail inspection device of claim 11, wherein the step sensor is further configured to measure a distance between the lower rail and the step sensor regardless of the inclination detection signal.

16. The rail inspection device of claim 11, further comprising an alarm display in the body and configured to display a warning alarm, wherein the alarm display is configured to display the warning alarm for the inclination of the body based on the inclination detection signal.

17. The rail inspection device of claim 11, wherein the inclination sensor is further configured to measure the inclination of the body in the first direction.

18. The rail inspection device of claim 11, further comprising:

a camera in the drive part and configured to capture an image of a driving environment of the drive part;

an operation bar removably attached to the body and configured to manually adjust a position or orientation of the body; and a controller in the operation bar and configured to change a location of the upper wheels and to control an operation of the camera.

19. A rail inspection device comprising:

a drive part configured to drive on a lower rail;

side wheels configured to rotate such that the drive part moves in a first direction on the lower rail, wherein the side wheels are on two side surfaces of the drive part opposite in a second direction that intersects the first direction;

a body connected to a lower surface of the drive part in a third direction that is perpendicular to the first direction and the second direction;

an inclination sensor on an upper surface of the body and configured to measure an inclination of the body;

a protruding-object detection sensor connected to a lower portion of the drive part and configured to detect a protruding object;

a width measurement sensor on a rear surface of the drive part and configured to measure a distance to the lower rail from the width measurement sensor in the second direction using a first laser;

a step sensor on a front surface of the drive part, configured to detect whether a front portion of the lower rail in a driving direction of the drive part is continuous or discontinuous and to identify a stepped portion of the lower rail based on the detected discontinuity, and to measure a distance to the stepped portion of the lower rail from the step sensor in the third direction using a second laser;

an alarm display on the body and configured to display a warning alarm; and a processor configured to control the inclination sensor, the protruding-object detection sensor, the width measurement sensor, the step sensor and the alarm display, wherein the inclination sensor is further configured to provide an inclination detection signal to the processor in-based on the inclination of the body being greater than or equal to a threshold value determined based on a rail design specification, wherein the protruding-object detection sensor is further configured to provide a protruding-object detection signal to the processor based on detecting the protruding object, wherein the width measurement sensor is further configured to provide a width detection signal to the processor based on the distance to the lower rail in the second direction deviating from a first threshold range determined based on the rail design specification, wherein the step sensor is further configured to provide a step detection signal to the processor based on the distance to the lower rail in the third direction deviating from a second threshold range determined based on the rail design specification, and wherein the processor is further configured to control the alarm display to display the warning alarm based on the inclination detection signal, the protruding-object detection signal, the width detection signal, or the step detection signal.

* * * * *